US006083063A

United States Patent [19]

Neisen

[11] Patent Number: 6,083,063

[45] Date of Patent: Jul. 4, 2000

[54] PUMP JET APPARATUS WITH ARTICULATING WEED GRATE CLEAN-OUT SYSTEM

[75] Inventor: Gerald F. Neisen, Rockport, Tex.

[73] Assignee: Outbound Marine Corporation, Waukegan, Ill.

[21] Appl. No.: 09/482,493

[22] Filed: Jan. 13, 2000

[51] Int. Cl.[7] ..... B63H 11/01

[52] U.S. Cl. ..... 440/46

[58] Field of Search ..... 440/38, 46; 114/221 R

[56] References Cited

U.S. PATENT DOCUMENTS

| | | | |
|---|---|---|---|
| 3,253,567 | 5/1966 | Patton, Jr. | 440/46 |
| 3,279,414 | 10/1966 | Rabald | 440/46 |
| 3,343,368 | 9/1967 | Castoldi | 440/46 |
| 3,797,447 | 3/1974 | Stubblefield | 440/46 |
| 4,027,617 | 6/1977 | Ikeda et al. | 440/46 |
| 4,373,919 | 2/1983 | Stangeland | 440/46 |
| 4,538,996 | 9/1985 | Inwood | 440/38 |
| 4,549,868 | 10/1985 | Lolly | 440/42 |
| 4,925,412 | 5/1990 | Karls | 440/71 |
| 5,083,948 | 1/1992 | Grobson | 440/49 |
| 5,123,867 | 6/1992 | Broinowski | 440/42 |
| 5,509,832 | 4/1996 | Roos | 440/47 |
| 5,577,941 | 11/1996 | Chartier | 440/46 |
| 5,690,520 | 11/1997 | Rheault | 440/46 |
| 5,876,258 | 3/1999 | Gray | 440/46 |
| 5,989,083 | 11/1999 | Ishigaki et al. | 440/46 |

*Primary Examiner*—Jesus D. Sotelo
*Attorney, Agent, or Firm*—John H. Pilarski; Dennis M. Flaherty

[57] ABSTRACT

An operator-actuated inlet grate clean-out mechanism which can be actuated by pushing and pulling a cable or rotating a shaft from the driver's seat of a boat. A weed wiper which is arranged to push weeds off of a pivotable cantilever-tine inlet grate as the wiper travels along the tines and toward the aft tips of the tines. As the wiper sweeps along the inlet grate tines, it bears against the inlet grate and causes the grate to swing downward to a position where the aft tips of the cantilever tines are spaced from the pump jet housing. Because the weeds wrap and ball around the inlet grate, they also slide off easily when pushed or dragged by the sweeping wiper bar.

27 Claims, 3 Drawing Sheets

PUMP JET APPARATUS WITH ARTICULATING WEED GRATE CLEAN-OUT SYSTEM

FIELD OF THE INVENTION

This invention generally relates to pump jet apparatus which are mounted to the hull of a boat or other water craft. In particular, the invention relates to mechanisms for cleaning out an inlet grate of a pump jet which has become clogged with weeds or other debris.

BACKGROUND OF THE INVENTION

It is known to propel a boat or other water craft using a pump jet apparatus mounted to the hull, with the powerhead being placed inside (inboard) the hull. The drive shaft of the pump jet apparatus is coupled to the output shaft of the inboard motor. The impeller is mounted on the drive shaft and housed in a jet propulsion duct or water tunnel.

To facilitate use of pump jet-propelled boats in shallow water, it is known to mount the pump jet at an elevation such that the pump jet does not project below the bottom of the boat hull. In one type of design, part of the pump jet apparatus is installed inside the hull while the remaining part penetrates the transom and extends to the rear of the hull. An inlet housing of the pump jet has a horizontal opening and an inlet ramp for guiding water into a water tunnel where the impeller resides. The horizontal opening of the inlet housing is mounted in a hole in the bottom or near the bottom of the hull.

When operating a pump jet-propelled boat in shallow water, it is possible to ingest seaweed and other debris into the housing when water is being drawn into the pump jet inlet. To prevent seaweed and other debris from entering the pump jet housing and possibly ensnarling or damaging the rotating impeller, a grate or screen is typically placed across the inlet opening. During continuous use of a pump jet-propelled watercraft in shallow, weed-infested water, floating weeds can accumulate on and become entangled with the inlet grate to such a degree that the inlet grate becomes clogged. In particular, in the case where the inlet grate comprises an array of mutually parallel tines, the suction created by the impeller causes weeds and other debris to wrap around the tines of the grate and slide rearwardly along the tines. The buildup of weeds, if allowed to continue unabated, can ultimately form a dense mass that reduces the intake of water through the inlet opening and into the pump jet. Reduced water flow can cause the jet pump to stall and the boat to stop moving.

The result is that the boat operator must unclog the inlet opening by removing the dense mass of entangled weeds from the tines of the inlet grate. However, removing entangled weeds from the inlet grate can be very difficult. This task can also be unpleasant if a person has to enter the water and submerge under the boat to remove the weeds. Moreover, even if the entangled weeds are successfully removed, when boat operation is resumed and the boat operator attempts to leave the weeded area, the inlet grate may become plugged after only a short distance, repeating the same clean-out problem.

One attempt at a solution to the problem of clogged inlet grates was disclosed in U.S. Pat. No. 5,577,941. In that disclosure, the inlet grate comprises a plurality of cantilever tines which extend rearwardly across the water intake and have suspended aft end tips spaced from the aft end of the water intake. This spacing enables rearward sliding of weeds and other debris along and then off of the cantilever tines without clogging. U.S. Pat. No. 5,577,941 characterizes this anti-clogging feature as being "automatic", with no additional mechanism being needed for unclogging.

U.S. Pat. No. 5,876,258 purports to be an improvement over the teaching of U.S. Pat. No. 5,577,941. In particular, U.S. Pat. No. 5,876,258 states that the inlet grate of U.S. Pat. No. 5,577,941 is problematic because the size of the gap between the end tips of the tines and the aft end of the weed grate plate limits the size and amount of weeds that can pass through the gap and through the pump jet. Thus, large clumps of weeds which have a thickness greater than the gap between the tines and the aft end of the inlet grate can cause clogging. Instead, U.S. Pat. No. 5,876,258 proposes an inlet grate comprising a plurality of cantilever tines each joined to a pivot rod. The cantilever tines extend across the inlet opening to prevent debris from entering the pump jet. A spring member is mounted between the cantilever tines and a mounting frame such that the spring member provides an outward rotational bias force against the rotatable cantilever tines. During operation of the watercraft, if a mass of weeds becomes clogged in the cantilever tines, the upward and inward suction force of the pump jet causes the cantilever tines to rotate upward against the opposing rotational bias force of the spring member. This self-activating mechanism allows the weeds to slide off of the ends of the cantilever tines and be ingested by the pump jet. This has the disadvantage that large volumes of weeds will plug up the pump jet at the impeller, making clean-out even more difficult than with a fixed-grate system. Also, when the inlet grate is open, hard debris, such as oysters, stones and sticks, can enter the pump jet, causing damage to the impeller.

There is a need for an inlet grate clean-out mechanism which can be actuated by a boat operator when conditions require and without ingested weeds or debris into the pump jet.

SUMMARY OF THE INVENTION

The present invention is directed to an operator-actuated inlet grate clean-out mechanism which can be actuated as often as required. By pushing and pulling a cable or rotating a shaft from the driver's seat, the boat operator can operate a weed wiper which is arranged to push weeds off of a pivotable cantilever-tine inlet grate as the wiper travels along the tines and toward the aft tips of the tines. As the wiper sweeps along the inlet grate tines, it bears against the inlet grate and causes the grate to swing downward to a position where the aft tips of the cantilever tines are spaced from the pump jet housing. Because the weeds wrap and ball around the inlet grate, they also slide off easily when pushed or dragged by the sweeping wiper bar even in large quantities. The invention enables fast and easy weed removal, without the necessity of the boat operator entering the water.

In accordance with the preferred embodiments disclosed herein, a system for propelling a boat or other watercraft comprises: a duct; an impeller located in the duct; an inlet grate which is pivotable relative to the duct and is arranged so that water entering the duct flows through the inlet grate, the inlet grate comprising a spaced array of cantilever tines; and means for wiping the tines in a lengthwise direction while simultaneously causing the inlet grate to pivot downward.

The invention is further directed to a method for clearing weeds off of a pivotable inlet grate comprising a plurality of cantilever tines. The method in accordance with the preferred embodiment comprises the step of wiping the cantilever tines in a lengthwise direction with sufficient bearing force to cause the inlet grate to pivot downward.

In accordance with the most preferred embodiment of the invention, a pump jet apparatus comprises: a housing having surfaces which form a duct; an impeller located in the duct; an inlet grate pivotably mounted to the housing and arranged so that water entering said duct flows through the inlet grate, the inlet grate comprising a spaced array of cantilever tines; and a wiper bar for wiping the tines in a lengthwise direction while simultaneously causing the inlet grate to pivot downward. The wiper bar is disposed across said tines and is movable between first and second positions by actuation of a wiper arm to which the wiper bar is coupled. The wiper bar bears against at least one of the cantilever tines during movement of the wiper bar from its first position to its second position. The pressure applied by the wiper bar causes the inlet grate to pivot from a first angular position (the running position) to a second angular position (the clean-out position) as the wiper bar moves from its first position to its second position. Preferably the tips of the tines are adjacent to the housing when the inlet grate is in the running position and are displaced away from the housing when the inlet grate is in the clean-out position. The amount of separation in the clean-out position should be sufficient to allow clumps of weeds to slide off of the cantilever tines, thereby unclogging the inlet grate.

In accordance with a further feature of the preferred embodiment, a spring is provided for urging the inlet grate to return from its clean-out position to its running position. The spring can be anchored to the housing. Alternatively or in addition, a return member can be mechanically linked to the wiper bar and disposed on the underside of the inlet grate such that the return member pushes the inlet grate up as the wiper bar is returned to the running position.

DETAILED DESCRIPTION OF THE PREFERRED EMBODIMENTS

For the purpose of illustration, the preferred embodiment of the weed grate clean-out system will be disclosed with reference to a pump jet apparatus which is mounted under a stern section of a boat hull and having an inlet opening lying generally in the plane of the hull bottom. However, it should be appreciated at the outset that the present invention has application in any type of pump jet apparatus having an inlet grate or weed grate (which terms will be used herein synonymously).

Figure 1:
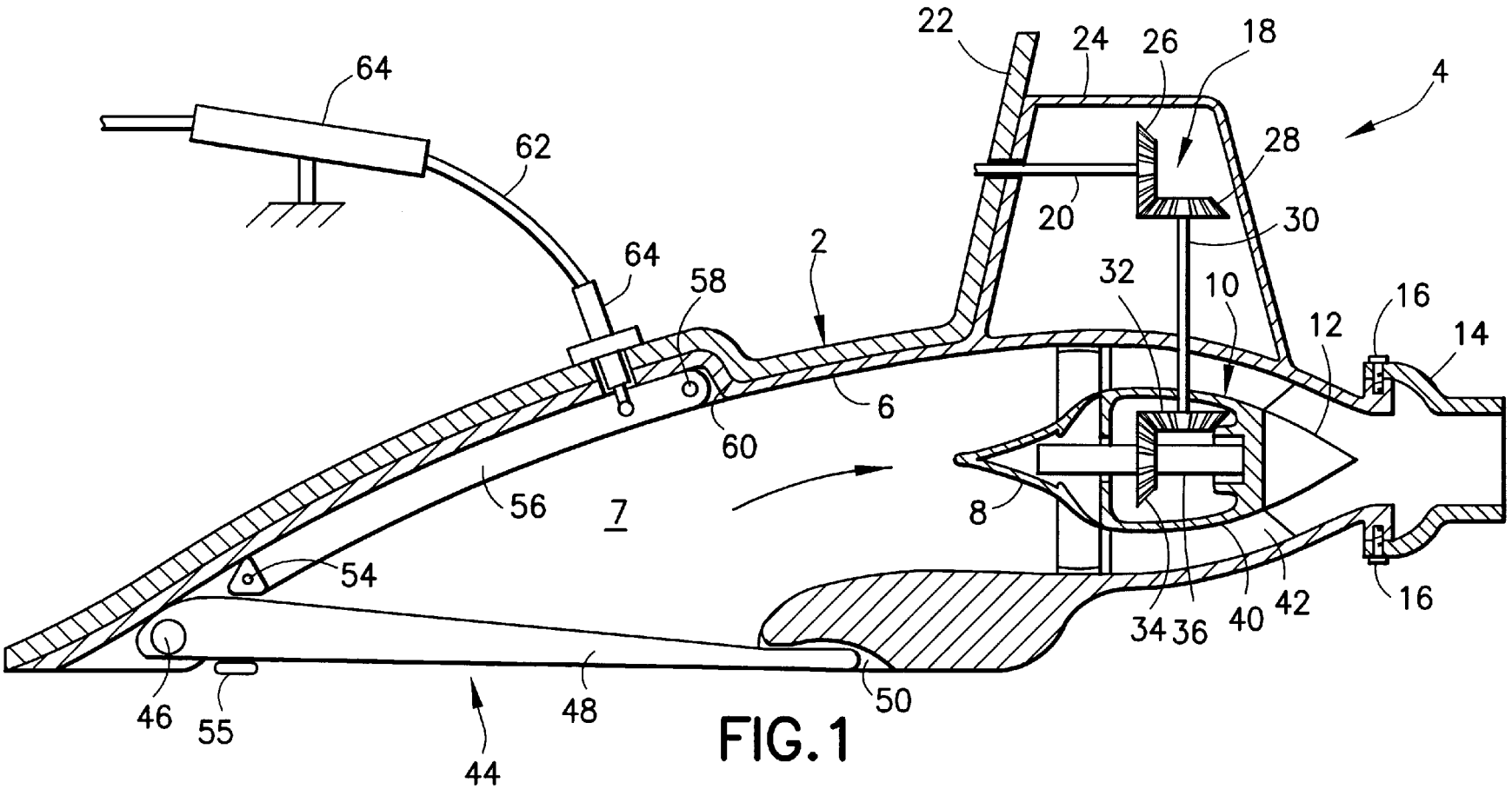
FIG. 1 is a schematic showing a sectional view of an exemplary pump jet apparatus incorporating a weed grate clean-out system in accordance with the preferred embodiment of the present invention.

FIG. 1 shows a portion of a boat hull 2 having a cavity in which an inlet portion of a pump jet apparatus 4 is installed. The inlet portion may comprise a separate component such as an inlet housing or may comprise the forward section of a pump jet housing which houses the impeller. FIG. 1 shows a single housing 6 which houses an impeller 8 having a plurality of blades, a stator 10 having a plurality of stator vanes, and a tail cone 12. However, it will be readily appreciated by persons skilled in the art that housing 6 may comprise multiple housing fastened together. For example, the housing 6 could comprise an inlet housing, a rotor housing for housing the impeller, a stator housing for housing the stator, and an exit nozzle. The interior surfaces of housing 6 form a duct which defines a water tunnel 7.

FIG. 1 also shows a steering nozzle 14 which is pivotably mounted to the housing 6 at the outlet of the housing, the steering nozzle being pivotable about a vertical axis defined by the centerline of a pair of pivot pins 16 to enable steering the boat. For the sake of simplicity, the levers, rods and cables for controlling the angular position of steering nozzle 14 are not shown since the present invention is not directed to steering mechanisms.

For the purpose of illustration, one type of gear drive train 18 is depicted for coupling to an inboard motor (not shown). It should be appreciated, however, that the invention can also be used with a pump jet having direct drive, provided that the wiper arm described below is laterally offset in deference to the drive shaft passing straight through the hull. In the exemplary drive train shown in FIG. 1, a horizontal drive shaft 20 is coupled to an output shaft (not shown) of the inboard motor. The drive shaft 20 penetrates the transom 22 and extends into the upper gear housing 24. A bevel drive gear 26 is mounted to the end of drive shaft 20. The teeth of bevel drive gear 26 mesh with a bevel gear 28 mounted to the end of a vertical drive shaft 30, which penetrates the pump jet housing 6. The opposite end of the vertical drive shaft 40 has a bevel gear 32 mounted thereto. The bevel gear 32 in turn meshes with a bevel gear 34 mounted on an impeller shaft 36 which has a portion extending forward of the vertical shaft 30. The impeller (i.e., rotor) 8 is mounted on the forward end of the impeller shaft 36 and may have a conventional structure.

The impeller shaft 36 is supported by bearings (not shown) arranged inside a hollow hub 40 of stator 10 having a streamlined exterior surface. The stator hub 40 is surrounded by housing 6. The interior surface of housing 6 is streamlined, so that the opposing surfaces of the housing 6 and hub 40 define a circumferential passageway through which the impelled water flows. The circumferential passageway forms part of the water tunnel 7. The housing 6 and hub 40 are preferably connected by a plurality of stator vanes 42.

In accordance with the exemplary drive train described above, an inboard engine provides a torque which drives the impeller shaft 36 to rotate via drive shafts 20 and 30, and gears 26, 28, 32, and 34. Rotation of the impeller shaft 36 in turn causes the impeller 8 to rotate. During rotation, the angled blades of the impeller 8 impel water in the aft direction through the circumferential passageway between housing 6 and hub 40. The stator vanes 42 function to redirect the swirling flow out of the impeller and eliminate swirl. The water exits the steering nozzle 14 as a downstream jet.

Figure 2:
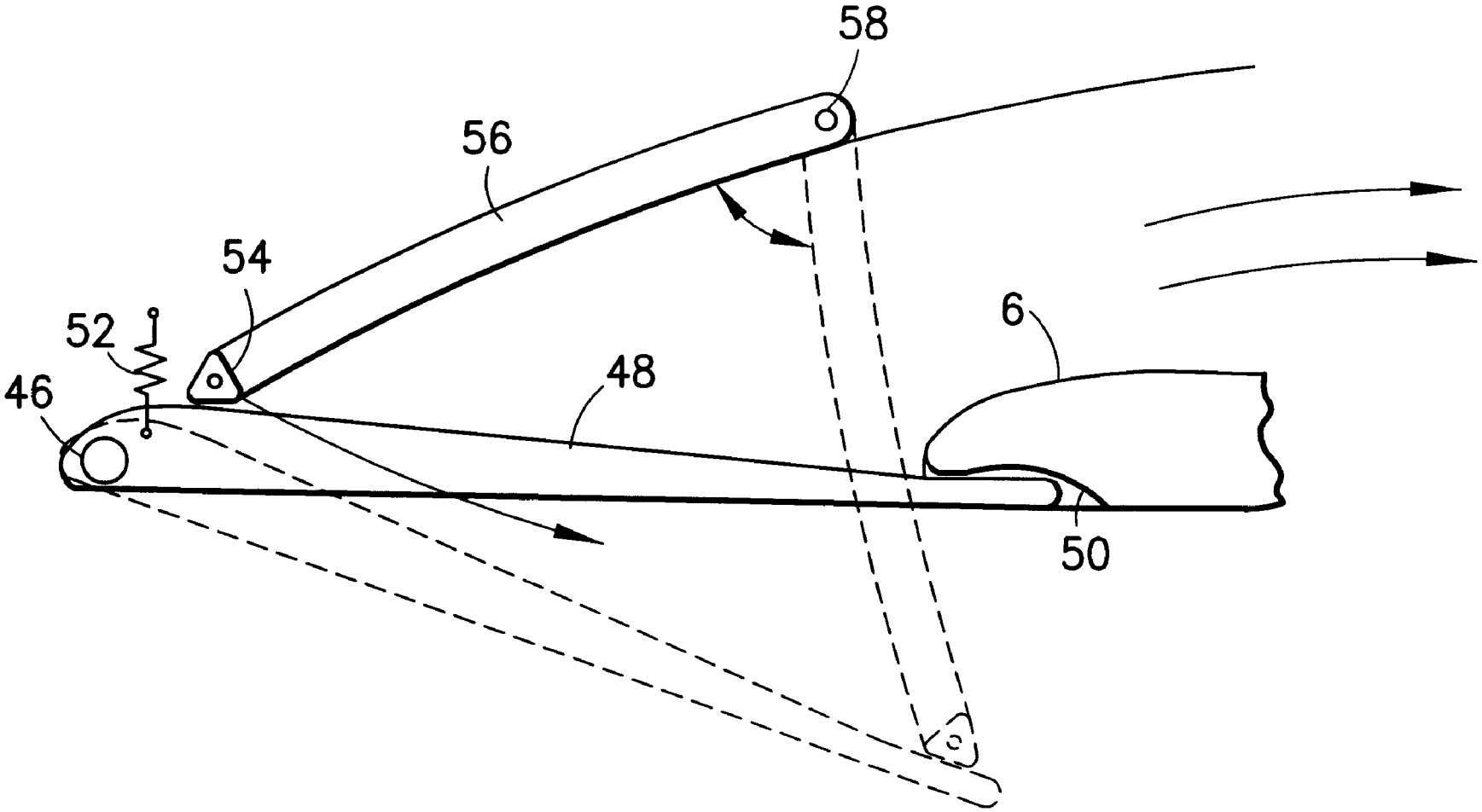
FIG. 2 is a schematic showing operation of the weed grate clean-out system depicted in FIG. 1, with the running position depicted by solid lines and the clean-out position depicted by dashed lines.
Figure 3:
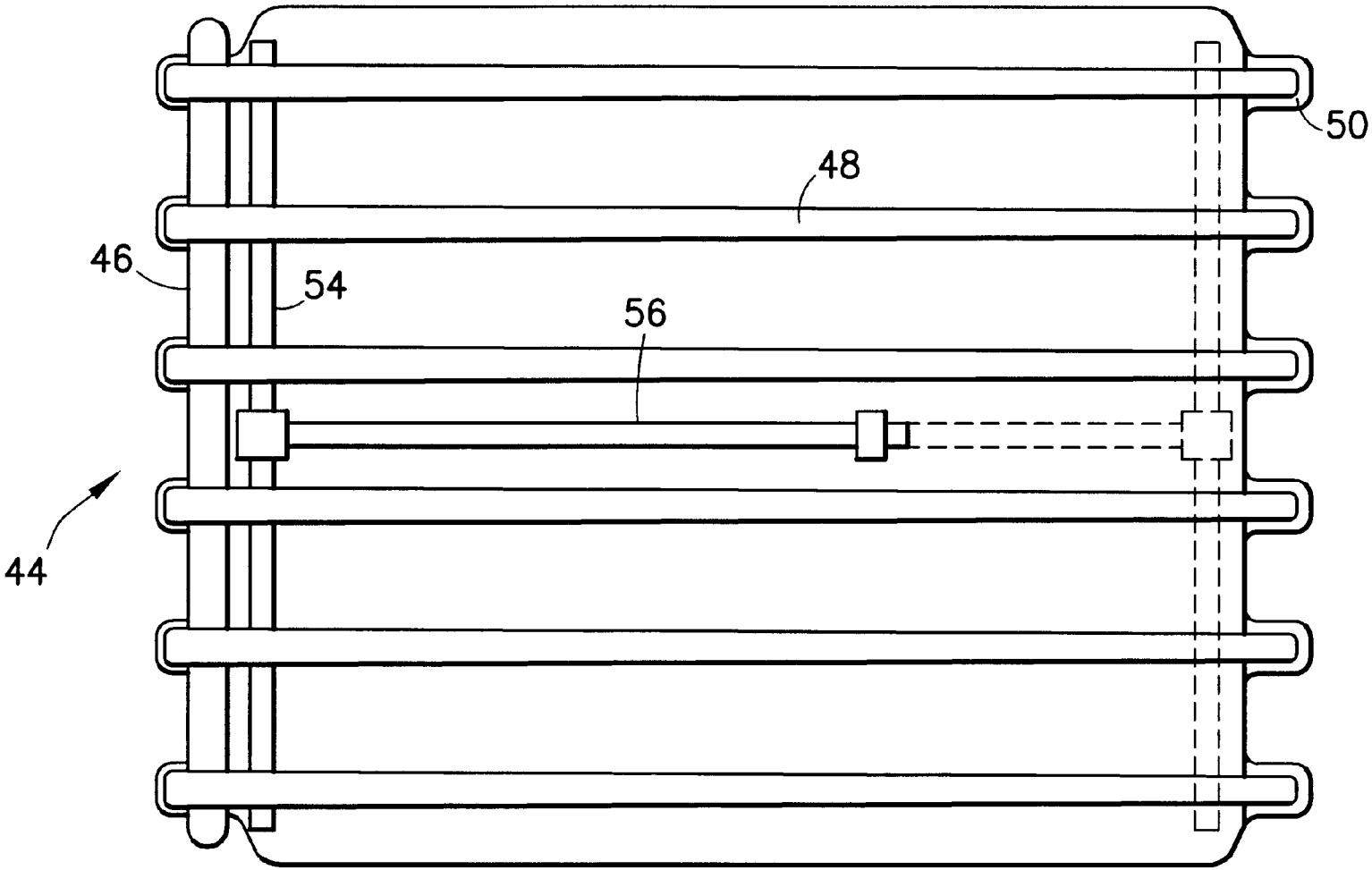
FIG. 3 is a schematic showing a bottom view of the weed grate clean-out system depicted in FIG. 1.

In accordance with the preferred embodiment of the invention shown in FIGS. 1–3, weeds and other debris are prevented from entering the water tunnel 7 by an inlet grate 44 which is pivotably mounted to the housing 6. The inlet grate 44 comprises a base 46 and a plurality of spaced cantilever tines 48. The opposing ends of base 46 are pivotably mounted in the housing 6. The inlet grate is pivotable about a pivot axis in a downward direction. During normal operation of the pump jet apparatus, the inlet grate is in a so-called "running" position, which is indicated by solid lines in FIG. 2. During a clean-out operation in accordance with the preferred embodiment, the inlet grate is pivoted downward to a so-called "clean-out" position indicated by dashed lines in FIG. 2. In accordance with a further feature, the housing is preferably provided with a plurality of recesses 50 at the aft end of the inlet opening. As best seen in FIG. 3, each recess 50 receives the tip of a respective cantilever tine when the inlet grate is in the running position.

In accordance with an optional feature, a spring 52 (shown only in FIG. 2) is provided for holding the inlet grate in the running position and for urging the inlet grate 44 to return from the clean-out position to the running position. The spring 52 can be anchored to the housing.

The weed grate clean-out system in accordance with the preferred embodiment comprises a wiper for wiping the tines 48 in a lengthwise direction while simultaneously causing the inlet grate 44 to pivot downward. The wiper comprises a wiper bar 54 disposed across the tines 48 and movable between first and second positions by actuation of a wiper arm 56, which is pivotably mounted to the housing 6 by a pivot pin 58. When the inlet grate 44 is in the running position, the wiper arm 56 is retracted into a recess 60 formed in housing 6. The retracted position of the wiper arm 56 is indicated by solid lines in FIG. 2. In response to operator actuation, the wiper arm rotates to an extended position indicated by dashed lines in FIG. 2. The wiper arm can be actuated to rotate by any conventional mechanical or electromechanical means. For the purpose of illustration, FIG. 1 shows a push-pull cable 62 which is slidable inside one or more tubes 64 affixed to the boat and which penetrates the hull 2 and the housing 6. One end of cable 62 is connected to a handle (not shown) manipulated by the boat operator and the other end of cable 62 is coupled to the wiper arm 56. Preferably, the other end of cable 62 is pivotably coupled to the wiper arm to facilitate adjustment of the angular position of the cable end relative to the wiper arm during displacement of the former and pivoting of the latter. The person skilled in the art will readily appreciate the need for proper water seals (not shown) where the push-pull cable 62 penetrates the hull.

In accordance with the preferred embodiment, the wiper bar 54 bears against at least one of the cantilever tines 48 during movement of the wiper bar from a first position when the wiper arm 58 is in its retracted position to a second position when the wiper arm 58 is in its extended position. The drawings show a wiper bar which is pivotably mounted to the wiper arm. However, this is not essential. The wiper bar could also be rigidly connected to the wiper arm.

In accordance with a further feature of the preferred embodiment shown in FIG. 1, the wiper may incorporate a return member 55 which is mechanically linked to the wiper bar 54 (the linkage is not shown in FIG. 1) and disposed on the underside of the inlet grate such that the return member pushes the inlet grate up as the wiper bar is returned to the running position. At a minimum, the return member 55 should bear against the underside of at least one tine 48. For example, the return member may comprise an L-shaped member welded or otherwise rigidly connected to the wiper bar 54.

The first and second positions of a pivotable wiper bar 54 are depicted in FIG. 3 by solid and dashed lines respectively. Preferably the wiper bar has a cross section such that the surface which bears against the inlet grate is relatively flat so that the wiper bar will slide, not roll, along the length of the tines. The wiper bar 54 sweeps across the tines 48 from the first position to the second position as the wiper arm 56 is actuated to rotate from its retracted position to its extended position (shown in FIG. 2). As the wiper bar sweeps across the tines, it pushes or drags clumps of debris which might be ensnarled or accumulated on the tines toward the tips of the tines. At the same time, in the running position of the inlet grate, the tines 48 are disposed inside the arc which the wiper bar 54 will travel during extension of the wiper arm 56. In response to the interference presented by the tines with which the wiper bar is in contact, the wiper bar will push the contacting tines out of the path of the wiper bar, causing the inlet grate to pivot downward toward the clean-out position indicated by dashed lines in FIG. 2. In the clean-out position, the tips of the tines are separated from the aft edge of the inlet opening by a distance sufficient to allow clumps of weeds or other debris to be pushed of off the inlet grate by the wiper bar. After the inlet grate has been unclogged, the boat operator actuates the wiper arm to rotate from its extended position to its retracted position, during which the spring 52 urges the inlet grate toward the running position.

In accordance with the preferred embodiment of the invention, the wiper bar is pivotably coupled to the wiper arm and extends substantially parallel to the pivot axis of the wiper arm. Also, the pivot axis of the inlet grate is substantially parallel to the pivot axis of the wiper arm.

While the invention has been described with reference to a preferred embodiment, it will be understood by those skilled in the art that various changes may be made and equivalents may be substituted for elements thereof without departing from the scope of the invention. For example, it will be apparent to a person skilled in the art that the cantilever tines of the inlet grate could be independently pivotable instead of being connected to a common pivotable base. Also, means other than a push-pull cable can be used to actuate the clean-out system disclosed above. For example, clean-out could be actuated by the boat operator using a wheel connected to a rotating shaft, which is in turn mechanically coupled to the wiper. Alternatively, electromechanical means could be used to actuate rotation of the wiper, in which case clean-out could be actuated by depression of a pushbutton on a control panel. In addition, many modifications may be made to adapt a particular situation to the teachings of the invention without departing from the essential scope thereof. For example, the pivotable inlet grate and articulated clean-out system disclosed herein could be installed in a duct formed in a boat hull, as opposed being installed in a duct of a pump jet apparatus mounted to a boat hull. Therefore, it is intended that the invention not be limited to the particular embodiment disclosed as the best mode contemplated for carrying out this invention, but that the invention will include all embodiments falling within the scope of the appended claims.

What is claimed is:

1. A pump jet apparatus comprising:

a housing having interior surfaces which form a duct;

an impeller located in said duct;

an inlet grate comprising a plurality of cantilever tines which are pivotable relative to said housing and which are arranged so that water entering said duct flows between said tines; and a wiper bar disposed across said tines and movable between first and second positions, said wiper bar bearing against at least one of said tines during movement of said wiper bar from said first position to said second position, and said tines pivoting from a first angular position to a second angular position as said wiper bar moves from said first position to said second position.

2. The pump jet apparatus as recited in claim 1, further comprising a wiper arm coupled to said wiper bar, wherein said wiper arm is pivotably mounted to said housing.

3. The pump jet apparatus as recited in claim 2, further comprising an actuator penetrating said housing and pivotably coupled to said wiper arm .

4. The pump jet apparatus as recited in claim 1, wherein said inlet grate further comprises a base pivotably mounted to said housing, said tines being connected to said base.

5. The pump jet apparatus as recited in claim 4, further comprising a spring coupled to said inlet grate for urging said tines to pivot from said second angular position to said first angular position.

6. The pump jet apparatus as recited in claim 2, wherein said wiper bar is pivotably coupled to said wiper arm.

7. The pump jet apparatus as recited in claim 2, wherein said housing comprising a recess for receiving said wiper arm in a retracted state.

8. The pump jet apparatus as recited in claim 1, wherein said housing comprises a plurality of recesses, each recess receiving a tip of a respective tine when said tines are in said first angular position.

9. The pump jet apparatus as recited in claim 1, wherein said tines extend across an inlet of said duct.

10. A pump jet apparatus comprising:

a housing comprising a duct;

an impeller located in said duct;

an inlet grate arranged so that water entering said duct flows through said inlet grate, said inlet grate comprising a base pivotably mounted to said housing and a spaced array of cantilever tines connected to said base; and a wiper bar disposed across said tines and movable between first and second positions, said wiper bar bearing against at least one of said tines during movement of said wiper bar from said first position to said second position, and said inlet grate pivoting from a first angular position to a second angular position as said wiper bar moves from said first position to said second position.

11. The pump jet apparatus as recited in claim 10, wherein the tips of said tines are adjacent to said housing in said first angular position of said inlet grate and are displaced away from said housing in said second angular position of said inlet grate.

12. The pump jet apparatus as recited in claim 10, further comprising a wiper arm having one end pivotably mounted to said housing and another end supporting said wiper bar.

13. The pump jet apparatus as recited in claim 12, wherein said wiper bar is substantially parallel to a pivot axis of said wiper arm.

14. The pump jet apparatus as recited in claim 12, wherein a pivot axis of said wiper arm is substantially parallel to a pivot axis of said inlet grate.

15. The pump jet apparatus as recited in claim 12, further comprising an actuator penetrating said housing and pivotably coupled to said wiper arm.

16. The pump jet apparatus as recited in claim 10, further comprising a spring coupled to said inlet grate for urging said inlet grate to pivot from said second angular position to said first angular position.

17. The pump jet apparatus as recited in claim 11, where in said wiper bar is pivotably coupled to said wiper arm.

18. The pump jet apparatus as recited in claim 11, wherein said housing comprising a recess for receiving said wiper arm in a retracted state.

19. The pump jet apparatus as recited in claim 10, wherein said housing comprises a plurality of recesses, each recess receiving a tip of a respective tine when said inlet grate is in said first angular position.

20. The pump jet apparatus as recited in claim 10, wherein said inlet grate extends across an inlet of said duct.

21. A system for propelling a boat comprising:

a duct;

an impeller located in said duct;

a drive train for converting motor torque into impeller rotation;

an inlet grate which is pivotable relative to said duct and is arranged so that water entering said duct flows through said inlet grate, said inlet grate comprising a spaced array of cantilever tines; and a wiper device disposed across said tines and movable between first and second positions, said wiper device bearing against at least one of said tines during movement of said wiper device from said first position to said second position, and said inlet grate pivoting from a first angular position to a second angular position as said wiper device moves from said first position to said second position.

22. The system as recited in claim 21, wherein the tips of said tines are adjacent to said duct in said first angular position of said inlet grate and are displaced away from said duct in said second angular position of said inlet grate.

23. The system as recited in claim 21, further comprising a wiper arm which is pivotable relative to said duct and supports said wiper device, a pivot axis of said wiper arm being substantially parallel to a pivot axis of said inlet grate.

24. The system as recited in claim 21, further comprising a spring coupled to said inlet grate for urging said inlet grate to pivot from said second angular position to said first angular position.

25. The sys tem as recited in claim 21, wherein said inlet grate extends across an inlet of said duct.

26. A system comprising:

a duct;

an impeller located in said duct;

an inlet grate which is pivotable relative to said duct and is arranged so that water entering said duct flows through said inlet grate, said inlet grate comprising a spaced array of cantilever tines; and means for wiping said ti nes in a lengthwise direction while simultaneously causing said inlet grate to pivot downward.

27. A method for clearing weeds off of a pivotable inlet grate comprising a plurality of cantilever tines, comprising the step of wiping the tines in a lengthwise direction with sufficient bearing force to cause said inlet grate to pivot downward.

* * * * *

UNITED STATES PATENT AND TRADEMARK OFFICE

CERTIFICATE OF CORRECTION

PATENT NO. : 6,083,063

DATED : July 4, 2000

INVENTOR(S) : Gerald F. Neisen

It is certified that error appears in the above-identified patent and that said Letters Patent is hereby corrected as shown below:

On the Title Page, Item [73] should read: Outboard Marine Corporation

Signed and Sealed this

Fifteenth Day of May, 2001

*Attest:*

Nicholas P. Godici

NICHOLAS P. GODICI

*Attesting Officer*

*Acting Director of the United States Patent and Trademark Office*